US005319314A

United States Patent [19]

Chen

[11] Patent Number: 5,319,314

[45] Date of Patent: Jun. 7, 1994

[54] ELECTRON ORBIT CONTROL IN A BETATRON

[75] Inventor: Felix K. Chen, Newtown, Conn.

[73] Assignee: Schlumberger Technology Corporation, New York, N.Y.

[21] Appl. No.: 941,474

[22] Filed: Sep. 8, 1992

[51] Int. Cl.[5] ..... H05H 11/00; H01J 23/34

[52] U.S. Cl. ..... 328/237; 328/233

[58] Field of Search ..... 328/233, 237, 67; 313/62; 307/246, 268; 315/5.41, 5.42

[56] References Cited

U.S. PATENT DOCUMENTS 4,972,082 11/1990 Loomis et al. ..... 250/269
5,077,530 12/1991 Chen ..... 328/233
5,107,222 4/1992 Tsuzuki ..... 328/233
5,122,662 6/1992 Chen et al. ..... 250/269

*Primary Examiner*—Sandra L. O'Shea
*Assistant Examiner*—Nimesh Patel
*Attorney, Agent, or Firm*—Brumbaugh, Graves, Donohue & Raymond

[57] ABSTRACT

A betatron, adapted, e.g., for use as a high-energy electromagnetic radiation source in a borehole well logging tool, includes modulator circuitry for actively controlling the electron beam radius during acceleration and for extracting the electron beam at or near maximum magnetic field strength. Such control may be effected by suitable separate pulsing of field-coil and core-coil magnets, and results in enhanced efficiency of betatron magnet-excitation power conversion and beam end-point energy stability and intensity over a range of operating temperatures.

11 Claims, 2 Drawing Sheets

ELECTRON ORBIT CONTROL IN A BETATRON

BACKGROUND OF THE INVENTION

This invention relates to magnetic induction accelerators of the betatron type and, more particularly, to active electron control circuits for betatrons.

1. Cross Reference to Related Patents

The invention of the present application is related to the invention described in the commonly-owned U.S. Pat. No. 5,077,530, issued Dec. 31, 1991 to the present inventor for Low-voltage Modulator for Circular Induction Accelerator, and to the invention described in the commonly-owned U.S. Pat. No. 5,122,662, issued Jun. 16, 1992 to the present inventor et al. for Circular Induction Accelerator in Borehole Logging, the disclosures of both of which are hereby incorporated by reference.

2. Background of the Invention

Prominent among performance criteria for betatrons, and in particular for miniature betatrons, as used, for example, in borehole logging tools, are power efficiency, beam end-point energy stability, and beam energy and flux stability under changing ambient temperature. Specifically as to power efficiency, two contributing factors may be distinguished, namely (i) the efficiency of a modulator in the conversion and delivery of power to the betatron magnet and (ii) the efficiency of conversion of the magnet excitation power into beam power. The former, namely modulator efficiency, is a primary concern of the aforementioned U.S. Pat. No. 5,077,530. The present invention is mainly concerned with the latter, namely the efficiency of magnet-excitation power conversion.

In a betatron, almost all the magnetic-circuit excitation energy is stored in the air gap of the field magnet. This is because the air gap in the magnetic circuit which provides the confining magnetic field is considerably wider than the air gap in the core magnetic circuit which provides the bulk of the acceleration voltage, and because of the high permeability of the core material. On the one hand, with the magnetic induction (field strength) B at an electron-beam target as a reference, the excitation energy is approximately proportional to $B^2$; on the other hand, the end-point energy of a relativistic beam in a betatron is proportional to r·B, where r is the radial position of the target. Furthermore, B is proportional to $r^{-n}$, with n between 0 and 1. Thus, optimal power conversion is realized if the target is placed at the outer edge of the field magnet and if the electron beam is extracted to strike the target when B is at its peak. Since the beam must be located within r during acceleration, the beam radius has to be expanded as the magnetic field increases towards its peak.

Prior art techniques for beam extraction have reduced the confining magnetic field either with an extraction coil and switch arrangement in the field magnetic circuit, or with a magnetic flux clamping circuit in the core circuit. These techniques are relatively simple to implement, but neither effects extraction of the beam at its maximum possible energy.

Typically, in an accelerator-based logging tool, e.g., a density tool, the electromagnetic radiation is relatively intense and has a short duty cycle, and the detectors operate in an energy deposition mode. In the case of a betatron as the radiation source, this holds true at least for near-spaced detectors. However, the total radiation energy depends not only on the amount of charge accelerated per pulse (which affects radiation intensity but not spectrum shape), but also on the end-point energy, affecting spectrum shape. While variations in radiation intensity are scalable (e.g., doubling the intensity will double the detector count rate without regard to source-detector spacing) and thus are normalizable, variations in end-point energy affect the radiation transport processes and affect detector response differently at different spacings. It is important, therefore, that end-point energy variation be kept as small as possible.

In a betatron, one important factor that affects the extracted beam energy is extraction timing. Since the end-point beam energy is determined mainly by B (i.e., by the magnetic induction at the target), and since B varies essentially sinusoidally, it is desirable to extract the beam when B is at or near its peak, where a change in extraction timing has the least effect on beam energy.

Magnetic properties of materials change as a function of temperature. Where power consumption is of no concern, a sufficiently large air gap in a magnetic circuit will minimize the magnetic effects of temperature changes; this, however, is impractical in the case of a miniature betatron, for borehole use, for example. In the case of a cut core made of Metglas S-3 and SC and without a large gap, as described, for example, in the aforementioned U.S. Pat. No. 5,122,662, the apparent permeability drops with temperature, with the core current increasing by as much as 50 percent for a temperature change of 50 degrees C. A larger current results in a higher resistive loss in the core, and this in turn modifies the betatron condition in such a way that the electron orbit shrinks with temperature. In such circumstances, unless corrected, at the least extraction will be delayed, because the smaller the electron orbit before expansion, the longer it takes to expand it to the target. In the extreme case, electrons may even strike the inside of the betatron "donut" before expansion takes place. A change in the betatron condition may further result in excessive electron loss, and hence a reduction in beam intensity.

SUMMARY OF THE INVENTION

Preferably, for optimized power conversion efficiency, beam end-point energy stability, and/or beam energy and intensity stabilities with respect to temperature variation, the electron beam radius in a betatron is actively controlled during acceleration. Preferred control results in electrons striking the target at or near maximum field strength, for all temperatures over the range of interest. In accordance with a preferred embodiment of the invention, an electron beam extraction circuit coupled in parallel with the high-voltage energization circuit for the betatron windings is actuated at the appropriate time to disrupt the betatron condition and extract the electron beam when the magnetic field is substantially at peak value.

In a preferred embodiment, the electron beam extraction circuit senses a parameter correlatable with the occurrence of the peak magnetic field strength, e.g., the timing location of the electromagnetic, radiation burst produced upon electron beam extraction, and generates control signals, as needed, to control the subsequent timing of actuation of the extraction circuit to maintain the sensed parameter at a predetermined value corresponding to the occurrence of the magnetic field peak. Thus, where the timing of the electromagnetic radiation burst is sensed, the control signals are generated so as to maintain subsequent electromagnetic radiation bursts at a predetermined time location. Preferably, the electron beam extraction circuit comprises a capacitive circuit coupled in parallel with the high-voltage energization circuit for the betatron windings so as to be charged concurrently with the high-voltage energization circuit. One or more normally-open switches in the extraction circuit are closed at the appropriate time by the aforementioned control signals to discharge the energy stored in the capacitive circuit into the betatron windings, e.g., the core winding, to disrupt the betatron condition and extract the electron beam at the optimum time relative to the occurrence of peak magnetic field strength. Extraction of the electron beam may therefore be consistently achieved when the magnetic field is at or near its peak value, notwithstanding the effects of temperature variation or other perturbing factors.

DETAILED DESCRIPTION OF PREFERRED EMBODIMENTS

Figure 1:
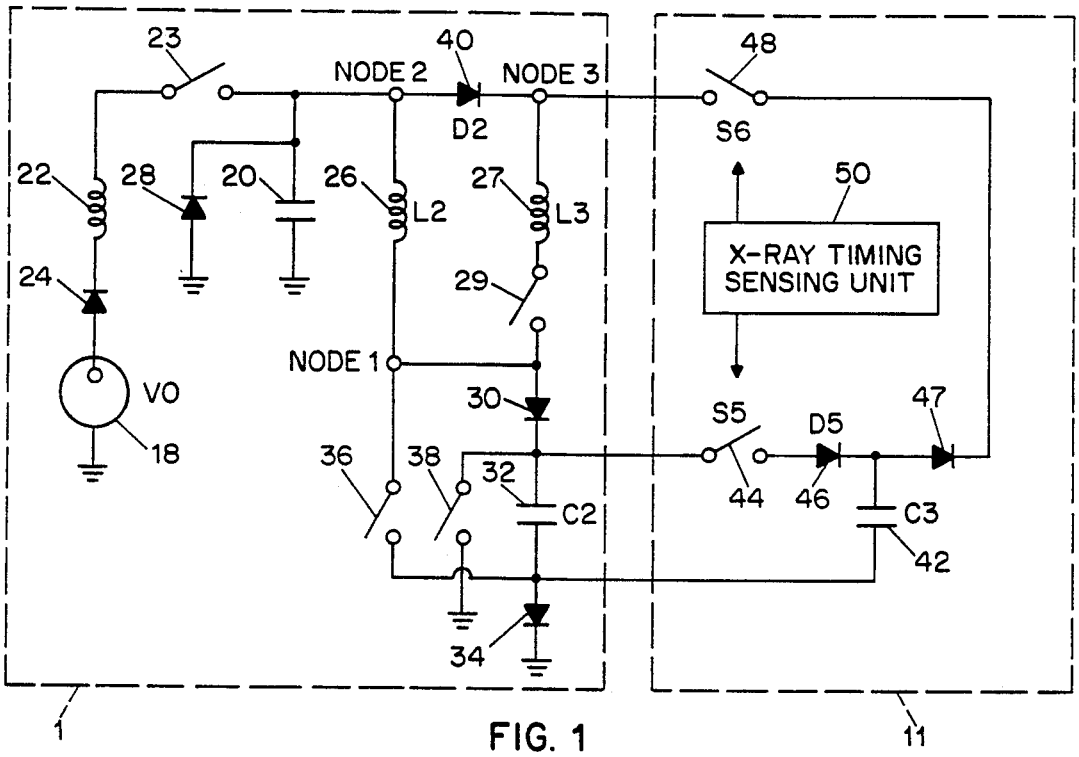
FIG. 1 is a schematic diagram of a modulator circuit in accordance with a preferred first embodiment of the invention.

The following observations and derivations apply to an idealized betatron system whose consideration is helpful in the appreciation of preferred embodiments of the invention. In such an idealized system, magnet-excitation power conversion efficiency is optimized upon maximization of the beam end-point energy at a given level of magnet excitation energy.

The betatron orbit, $r_0$, is related to the total magnetic flux $\phi$ within $r_0$ and to the magnetic induction B at $r_0$ through the following relation, which is known as the betatron condition:

$$\Delta\phi/\Delta B = 2\pi \cdot r_0^2 \quad (1)$$

where $\Delta$ is a difference operator for an incremental change in time. To maintain a constant betatron orbit, the left-hand-side ratio must be kept constant. This is usually achieved with a technique known as flux forcing.

The voltages applied to the field and core coils are related to the respective magnetic fluxes through the following relations:

$$V_c = N_c \Delta\phi_c/\Delta t + I_c R_c \quad (2)$$

$$V_f = N_f A \cdot \Delta B^*/\Delta t + I_f R_f \quad (3)$$

where c as a subscript refers to the core coil and f to the field magnet coil. V is the applied voltage, N the number of turns of the winding, I the corresponding driving current, R the effective magnet circuit resistance, B. the average magnetic induction, and A the cross-sectional area of the pole face. If the circuit is designed so that $$I_c R_c = I_f R_f \quad (4)$$

then, by maintaining $$V_c = V_f \quad (5)$$

by connecting the two coils in parallel, $$\Delta\phi_c/\Delta B^* = N_f A/N_c \quad (6)$$

is obtained.

The left hand side of equation (6) is directly proportional to the left hand side of equation (1). The right hand side of equation (6) is simply a geometrical constant. As a result, the betatron condition is satisfied.

When, due to a change in temperature, equation (4) no longer applies, the value of $V_c$ or $V_f$ may be adjusted to accommodate for the change. To this end, however, a simple parallel connection of the two coils is no longer sufficient. For example, if the magnetic circuit is designed for room temperature, and if the actual temperature rises, then a suitable increase of $V_c$ or reduction of $V_f$ will keep the betatron condition satisfied. Because the energy associated with the core circuit is considerably less than the energy in the field circuit, changing $V_c$ requires less power, so that, in the interest of economy, changing $V_c$ is preferred. Suitable voltage adjustments may be carried out interactively and continuously.

In accordance with the present invention, a preferred voltage adjustment may be effected, e.g., by modulator circuitry disclosed in the aforementioned U.S. Pat. No. 5,077,530, as suitably modified by the addition of "turbo-charge" circuitry, as illustrated in FIGS. 1 and 2 for example.

Figure 2:
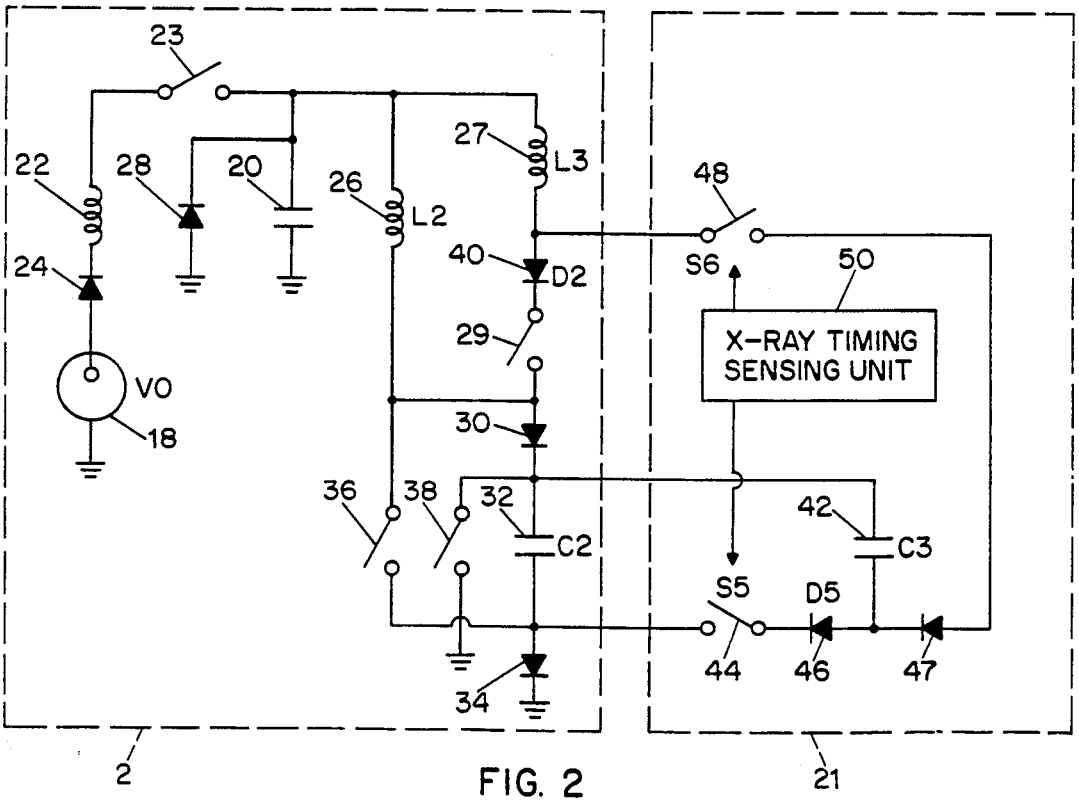
FIG. 2 is a schematic diagram of a modulator circuit in accordance with a preferred second embodiment of the invention.

Shown in FIG. 1 is a main discharging and energy recovery (modulator) circuit 1 of a type disclosed in the aforementioned U.S. Pat. No. 5,077,530. Circuit 1 includes a direct-current, low-voltage power supply 18, typically for supplying a voltage in the range of 10 to 100 volts. Via a diode 24, an isolation choke 22, and a charging switch 23, the power supply 18 is connected in parallel with a low-voltage storage capacitor 20, as well as to the positive side of the field-coil winding 26 (having inductance $L_2$) and, via a diode 40, to the positive side of the core-coil winding 27 (having inductance $L_3$). Although the field-coil and core-coil windings are illustrated as separate windings in FIG. 1, it will be understood that a single primary winding could be used to drive both the field magnet and the core magnet if desired. As described in U.S. Pat. No. 5,122,662, a secondary winding would then be used to provide the difference in magneto-motive force between the core and field magnets.

Charging switch 23 provides isolation for the power supply and may be implemented in the form of a bank of field-effect transistors, for example. In such implementation, in which field-effect transistors have intrinsic body diodes connecting source to drain, diode 24 prevents reverse current flow. Diode 40 isolates the field-coil winding 26 from the core-coil winding 27 during activation of the turbo-charge unit described below.

The negative side of the field-coil winding 26 is connected via a blocking diode 30 to a high-voltage storage capacitor 32 (having capacitance $C_2$), and the negative side of the core-coil winding 27 is similarly connected to the capacitor 32 via orbit-compression switch 29. This switch 29 is open during electron injection and closed during acceleration and expansion. The diode 34 isolates the capacitor 32 from ground.

As will be appreciated, and as is described more fully in the aforementioned U.S. Pat. No. 5,077,530, the capacitor 20, choke 22 and diode 24 form a low-voltage charging circuit for transferring energy through the field-coil winding 26 and the core-coil winding 27 to the high-voltage excitation circuit comprised by the diode 30, capacitor 32, and diode 34. Diode 28 is included to prevent reverse-charging of capacitor 20, but may be omitted as redundant depending on betatron operating conditions. Switches 36 and 38 permit, selectively, (1) current flow from the low-voltage capacitor 20 through the field-coil winding 26 and the core-coil winding 27 to the high-voltage capacitor 32 and (2) reverse current flow so as to discharge the combined charge of both capacitors 20 and 32 through the windings 26 and 27 and thereby excite the field-coil and core-coil circuits.

In accordance with the invention, the main modulator circuit 1 is shown augmented by an embodiment 11 of a "turbo charge unit" for electron orbit control. Unit 11 includes an additional high-voltage capacitor 42 (having capacitance $C_3$) which is connected in parallel to the main energy storage capacitor 32 via a charging switch 44 and a charging diode 46. In operation, the capacitor 42 is charged together with the main capacitor 32; however, the voltage of capacitor 42 is controlled by the switch 44. During discharge, the energy stored in capacitor 42 is blocked by a switch 48 until the onset of orbit expansion, or when a shift in x-ray burst timing is detected by an x-ray timing sensing unit 50. At that time, a timing control circuit sends the required trigger signal to switch 48 and releases the energy in capacitor 42 into the core-coil winding 27. The voltage blocking diode 40 blocks the higher voltage across the core-coil winding 27 from the voltage across the field-coil winding 26; thus, the core-coil and field-coil discharging paths are isolated. The timing control circuit may raise or lower the voltage of capacitor 42, or change its discharging timing as appropriate, to maintain the x-ray burst timing substantially constant.

To prevent the turbo charge unit 11 from exhausting its energy before the electron beam strikes the target, the following condition is sufficient:

$$L_3 \cdot C_3 \geqq L_2 \cdot C_2 \qquad (7)$$

This is not a necessary condition, however, as onset of the discharge of the capacitor 42 is delayed with respect to the discharge of the capacitor 32. Typically, the core-coil inductance $L_3$ is an order of magnitude larger than the field-coil inductance $L_2$, representative values being $L_2=85\ \mu H$ and $L_3=750\ \mu H$, with $C_2=5\ \mu F$. Thus, preferably, the capacitor 42 has relatively low capacitance $C_3$, e.g. about 0.5 $\mu$f. However, it is important to bear in mind that the inductance $L_3$ of the core-coil winding 27 is inversely related to temperature, and that the capacitance $C_3$ of capacitor 42 should be selected such that, throughout an intended operating temperature range, the capacitor 42 does not fully discharge before beam extraction is complete.

FIG. 2 depicts an alternative circuit arrangement, including a main modulator circuit 2 and a turbo charge unit 21 with components analogous to those of units 1 and 11 of FIG. 1 and interconnected as shown. Like reference numbers are used to identify like parts. In the circuit in accordance with FIG. 1, orbit control is effected by raising the voltage at the positive terminal of the core-coil winding 27; conversely, to the same effect, voltage is lowered at the negative terminal of the core-coil winding 27 in the circuit in accordance with FIG. 2. In both embodiments, the diodes 46 and 47 serve to block reverse current, similar to the function of diode 24 discussed above. Such blocking is of particular importance with switches 44 and 48 including field-effect transistors.

Figure 3:
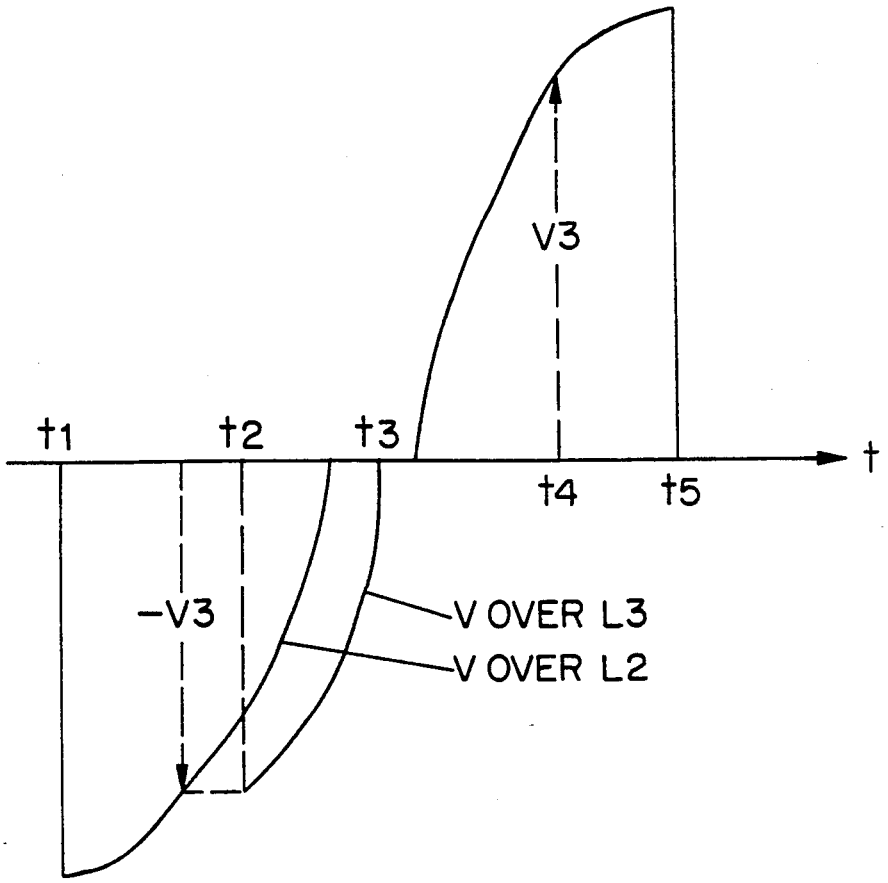
FIG. 3 is a graphic representation of typical voltage waveforms across the core-coil and the field-coil windings in a betatron equipped with a modulator circuit of the invention.
Figure 4:
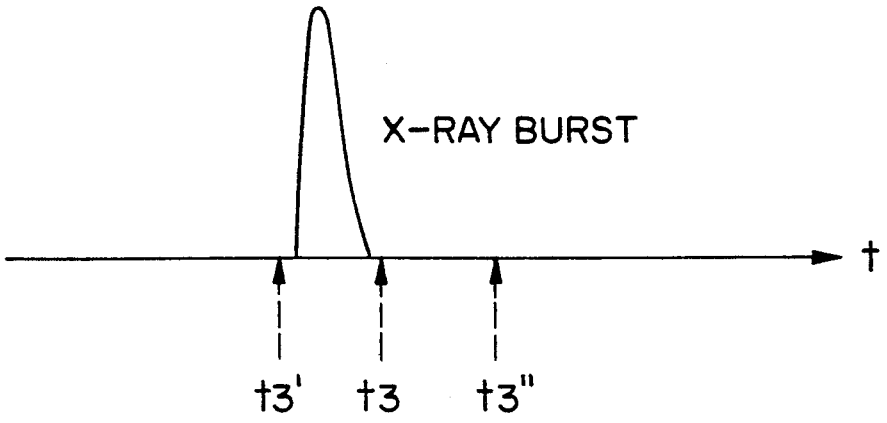
FIG. 4 graph representation of typical x-ray burst energy from a target, in correspondence with the voltage waveforms of FIG. 3.

Functioning of the turbo-charge unit may be appreciated in further detail with reference to the timing diagrams of FIG. 3 and 4, where the instances t , $t_3$ and $t_5$ are related to instances with the same designations in the aforementioned U.S. Pat. No. 5,077,530. As described above, the electron orbit is expanded when the voltage $V_c$ in accordance with equation 2 is raised above the voltage $V_f$ in accordance with equation 3. The capacitor 42 is charged during the energy recovery period ($t_3$ to $t_5$) upon closing of the switch 44. If switch 44 remains closed for the entire energy recovery period, the voltage across the additional capacitor 42 is the same as the voltage across the main capacitor 32, otherwise it is lower. The turbo-charge unit can be activated only after the voltage across the main capacitor 32 (which is the same as the voltage across the field coil winding 26 and the core-coil winding 27) has dropped below the voltage across the additional capacitor 42. Otherwise, diode 47 blocks the energy in the additional capacitor 42 from being discharged.

When the turbo-charge unit is activated by closing switch 48, the voltage across the main capacitor 32 is imposed upon the core coil 27. Since this voltage is greater than the voltage across the field-coil winding 26, the diode 40 is reverse biased and sustains the higher voltage across the core coil 27 for the remainder of the acceleration period. The core-coil current and the field-coil current follow separate paths after the activation of the turbo circuit: While the field circuit loop remains the same as before (26-36-32-38-20-26) the core circuit loop (27-29-36-42-48-27) goes through the turbo unit and bypasses the capacitors 32 and 20.

In FIG. 3, $V_3$ represents the voltage to which the additional capacitor 42 is charged. This voltage waveform is obtained by subtracting the voltage at Node 2 from the voltage at Node 1 of FIG. 1. The voltage waveform over the core-coil winding is obtained by subtracting the voltage at Node 3 from the voltage at Node 1 of FIG. 1. The two wave forms overlap before the turbo circuit is activated. The acceleration period starts at $t_1$ and ends at $t_3$, the energy recovery period extends from $t_3$ to $t_5$. During the orbit expansion period between $t_2$ and $t_3$, the voltage across the core coil is substantially higher than the voltage across the field coil. The turbo charging switch 44 is closed immediately following the opening of switch 48, and remains closed until $t_4$, at which time the voltage at capacitor 42 reaches $V_3$. The cycle repeats thereafter.

The trigger signals for the switches 44 and 48 may be generated in various known ways. Since maintaining the x-ray burst near the peak of the current waveform (or the minimum of the voltage waveforms—see FIG. 3 of U.S. Pat. No. 5,077,530) is desirable for purposes of the present invention, an x-ray timing sensing unit 50 is preferably used to detect the timing of the electromagnetic radiation burst. This may be done, for example, by measuring the electromagnetic radiation burst by use of a gamma ray detector, such as a NaI scintillator detector or other suitable detector, positioned close to the betatron. The peak of the burst is then determined and compared with a preset burst peak time location. Circuitry for performing these functions is disclosed, for example, in U.S. Pat. No. 4,972,082, the pertinent disclosure of which is hereby incorporated by reference.

An alternative technique for x-ray timing sensing may be described as follows: Desired x-ray burst timing between $t_3'$ and $t_3$, during which time interval the main switches 36 and 38 remain closed, is realized at essentially peak field-coil current. To this end, the time interval from $t_3'$ to $t_3$, here designated as Gate 2, is a sliding gate of fixed width whose position is adjusted for peak field-coil current. With Gate designating a suitable time interval (of 10 μs duration, for example) immediately preceding Gate 2, and Gate 3 a suitable time interval (also of 10 μs duration, for example) immediately following Gate 2, integrating x-ray monitors for Gates 1, 2 and 3 ideally should read zero for Gates 1 and 3. In this case, the current position of Gate 2 can remain unchanged. If the x-ray burst has shifted into Gate 1, the voltage of turbo capacitor 42 should be reduced by shortening of its charging time upon shifting $t_4$ to the left. Conversely, if x-rays are detected in Gate 3, $t_4$ should be shifted to the right. Standard circuitry and computer control can be used for such adjustment operations.

With either technique, an error signal is generated that can be used to adjust the timing of the trigger signals to the switches 44 and 48 as required. If the x-ray burst is shifted to a later time, it can be moved back by either starting the electron beam orbit expansion at an earlier time (shifting $t_2$ to the left in FIG. 3) or by increasing $V_3$ (shifting $t_4$ to the right in FIG. 3).

The invention is of particular commercial interest in borehole logging use and wherever small size and/or low power consumption are of concern in a betatron. Thus, for example, the invention may be used in portable radiography units.

Although the invention has been described and illustrated herein by reference to specific embodiments thereof, it will be understood that such embodiments are susceptible of variation and modification without departing from the inventive concepts disclosed. All such variations and modifications, therefore, are intended to be included within the spirit and scope of the appended claims.

I claim:

1. A modulator circuit for a betatron having at least one magnetizing winding, comprising:

a low-voltage d.c. power supply;

means defining a low-voltage capacitive circuit coupled between one pole of said power supply and one side of said magnetizing winding;

means defining a high-voltage capacitive circuit coupled between the other side of said magnetizing winding and the other pole of said power supply;

switching means for repetitively permitting electrical current flow from said power supply through said low-voltage capacitive circuit and said magnetizing winding to charge said high-voltage capacitive circuit and for reversing electrical current flow between said high-voltage capacitive circuit and said low-voltage capacitive circuits to discharge the electrical energy stored in said high-voltage circuit and low-voltage capacitive circuits through said magnetizing winding, whereby an electron beam captured in the magnetic field generated by said magnetizing winding is accelerated; and means for extracting the electron beam when the magnetic field generated by the magnetizing winding is substantially at peak value.

2. The modulator circuit of claim 1, wherein said beam extraction means includes:

means for determining the time location of the electromagnetic radiation bursts produced upon electron beam extraction; and means for controlling the timing of subsequent extraction of the electron beam to maintain the timing of the electromagnetic radiation bursts at substantially a predetermined time location.

3. The modulator circuit of claim 1, wherein said beam extraction means includes:

high-voltage capacitive means coupled in parallel to said high-voltage capacitive circuit; and means for discharging said high-voltage capacitive means through said magnetizing winding to cause extraction of the electron beam.

4. The modulator circuit of claim 3, wherein:

said high-voltage capacitive circuit includes unidirectional current means operatively coupled to said other side of said magnetizing winding to prevent reverse current flow between said high-voltage capacitive circuit and said low-voltage capacitive circuit; and said high-voltage capacitive means is coupled across said unidirectional current means to said magnetizing winding.

5. The modulator circuit of claim 4, wherein:

said betatron includes separate field-coil and core-coil windings;

both of said field-coil and core-coil windings are coupled between said low-voltage capacitive circuit and said high-voltage capacitive circuit; and said high-voltage capacitive means is coupled across said unidirectional current means to one of said field-coil and core-coil windings.

6. The modulator circuit of claim 3, wherein:

said means for discharging said high-voltage capacitive means includes normally-open switch means; and said beam extraction means includes means for closing said normally-open switch means when said magnetic field is substantially at peak value.

7. The modulator circuit of claim 6, wherein said switch-closing means includes:

means for determining the time location of the electromagnetic radiation bursts produced upon electron beam extraction; and means for controlling the subsequent operation of said switch-closing means to maintain the timing of the electromagnetic radiation bursts at substantially a predetermined time location.

8. The modulator circuit of claim 1, wherein said betatron comprises a miniature betatron.

9. A modulator circuit for a betatron having a field-coil winding and a core-coil winding, comprising:

a low-voltage d.c. power supply;

low-voltage capacitive means and high-voltage capacitive means coupled across the power supply;

the field-coil and core-coil windings being coupled in inductive charging relationship between the low-voltage and high-voltage capacitive means;

first unidirectional current means operatively coupled between the field-coil and core-coil windings and the second capacitive means for normally permitting current flow from the first capacitive means through the field-coil and core-coil windings to the second capacitive means but preventing reverse current flow;

first switching means for selectively reversing the direction of current flow between the high-voltage capacitive means and the low-voltage capacitive means to discharge the energy stored in the low-voltage and high-voltage capacitive means into the field-coil and core-coil windings;

third capacitive means coupled in parallel with the high-voltage capacitive means via second switching means and second unidirectional current means, said second unidirectional current means permitting charging of said third capacitive means concurrently with the charging of said high-voltage capacitive means but preventing reverse current flow; and control means for actuating the second switching means to discharge said third capacitive means into the core-coil winding to cause extraction of the electron beam.

10. The modulator circuit of claim 9, wherein said control means includes:

means for determining the time location of the electromagnetic radiation bursts produced upon electron beam extraction; and means for controlling the subsequent actuation timing of the said second switch means to maintain the timing of the electromagnetic radiation burst at substantially a predetermined time location.

11. The modulator circuit of claim 9, wherein said betatron is a miniature betatron.

* * * * *

UNITED STATES PATENT AND TRADEMARK OFFICE

CERTIFICATE OF CORRECTION

PATENT NO. : 5,319,314

DATED : June 7, 1994

INVENTOR(S) : Felix K. Chen

It is certified that error appears in the above-indentified patent and that said Letters Patent is hereby corrected as shown below:

Col. 3, line 30, "FIG. 4" should read --FIG.4 is a--;
Col. 3, line 66, "B." should read --B*--;
Col. 6, line 10, "t" should read --$t_1$--;
Col. 7, line 12, "Gate" should read --Gate 1--.

Signed and Sealed this

Thirteenth Day of December, 1994

*Attest:*

Bruce Lehman

BRUCE LEHMAN

*Attesting Officer*

*Commissioner of Patents and Trademarks*